United States Patent [19]

Okano

[11] 4,382,747

[45] May 10, 1983

[54] COMPRESSOR OF A TURBOCHARGER

[75] Inventor: Hiroshi Okano, Mishima, Japan

[73] Assignee: Toyota Jidosha Kogyo Kabushiki Kaisha, Toyota, Japan

[21] Appl. No.: 168,314

[22] Filed: Jul. 10, 1980

[30] Foreign Application Priority Data

Apr. 1, 1980 [JP] Japan ..... 55-41143

[51] Int. Cl.[3] ..... F01D 1/02; F04D 29/44; F04D 29/46

[52] U.S. Cl. ..... 415/207; 415/211; 415/219 A; 415/219 C

[58] Field of Search ..... 415/204, 206, 207, 211, 415/219 R, 219 A, 219 B, 219 C, DIG. 3, DIG. 1

[56] References Cited

U.S. PATENT DOCUMENTS

| | | | |
|---|---|---|---|
| 2,494,328 | 1/1950 | Bloomberg | 415/DIG. 1 |
| 2,641,442 | 6/1953 | Buchi | 415/211 |
| 2,925,952 | 2/1960 | Garve | 415/211 |
| 3,868,196 | 2/1975 | Lown | 415/219 A X |
| 4,181,466 | 1/1980 | Owen | 415/207 X |

*Primary Examiner*—Philip R. Coe
*Assistant Examiner*—Timothy F. Simone
*Attorney, Agent, or Firm*—Parkhurst & Oliff

[57] ABSTRACT

A turbocharger comprising a compressor which has a radially extending vaneless diffuser arranged between an impeller and an air discharge chamber. The vaneless diffuser is formed between a first annular surface and a second annular surface which are arranged in parallel to each other. The first annular surface is formed on the center housing of a turbocharger. The second annular surface is formed on an annular separating member which separates the vaneless diffuser from the air discharge chamber. The first annular surface is connected to the inner surface of the air discharge chamber, which is located furthest from the impeller. The first annular surface has a concavely curved portion at the connecting portion of the first annular surface and the inner wall of the air discharge chamber.

9 Claims, 3 Drawing Figures

COMPRESSOR OF A TURBOCHARGER

DESCRIPTION OF THE INVENTION

The present invention relates to a compressor of a turbocharger for use in an internal combustion engine.

Since a turbocharger of a small size used for a motor vehicle is required to operate within the wide range of flow rates of air sucked into an engine, a vaneless diffuser is used in the compressor of such a turbocharger. This vaneless diffuser is normally formed between paired annular walls arranged in parallel to each other. In addition, one of the paired annular walls, that is, a first annular wall is connected to the inner wall of the air discharge chamber of the compressor, which inner wall is positioned furthest from the impeller of the compressor, so that the first annular wall intersects with the inner wall of the air discharge chamber at a right angle. Furthermore, the other paired annular wall, that is, a second annular wall is arranged to extend to the vicinity of the inner wall of the air discharge chamber of the compressor, which inner wall is positioned furthest from the impeller of the compressor, so that the second annular wall separates the vaneless diffuser from the air discharge chamber. When the turbocharger is operated, air is forced into the vaneless diffuser due to the rotating motion of the impeller. After this, the air flows out from the vaneless diffuser and then flows along the above-mentioned first annular wall. After this, the air impinges upon the inner wall of the air discharge chamber and then, the flow direction of the air changes by a right angle at the connecting portion of the first annular wall and the inner wall of the air discharge chamber. As a result of the impingement of the air and the change in the flow direction, the air is stirred. Then, the air flows into the air discharge chamber. However, the flow velocity of the air, flowing out from the vaneless diffuser, is rather high and, therefore, if the first annular wall is arranged to intersect with the inner wall of the air discharge chamber at a right angle as mentioned above, a part of the velocity energy of the air is ineffectively lost due to the impingement of the air, the change in the flow direction and the stirring operation of the air, which are caused at the connecting portion of the first annular wall and the inner wall of the air discharge chamber. As a result of this, since a part of the velocity energy can not be effectively converted to an increase in the air pressure, a problem occurs in that the efficiency of a compressor will be reduced.

An object of the present invention is to provide a turbocharger capable of effectively converting the velocity energy of air flowing out from the vaneless diffuser, into an increase in the air pressure.

According to the present invention, there is provided a turbocharger comprising a center housing, a compressor housing fixed onto the center housing, an impeller arranged in the compressor housing, a scroll shaped air discharge chamber formed in the compressor housing around the impeller and having an inner wall defining the air discharge chamber therein, the inner wall of the air discharge chamber having a cylindrically axially extending inner wall portion which is positioned furthest from the impeller, and a radially extending vaneless diffuser arranged between the impeller and the air discharge chamber, the center housing having a first annular surface which radially extends from the vicinity of the impeller to the inner wall portion of the air discharge chamber, the compressor housing having a radially extending annular separating portion which separates the vaneless diffuser from the air discharge chamber, the annular separating portion having a second annular surface which is arranged parallel to the first annular surface and extends from the vicinity of the impeller to the vicinity of the inner wall portion of the air discharge chamber, the first annular surface and the second annular surface defining the vaneless diffuser therebetween, wherein the first annular surface of the center housing has a concavely curved portion at a position near the inner wall portion of the air discharge chamber, the concavely curved portion gradually curving from the first annular surface towards the inner wall portion of the air discharge chamber.

The present invention may be more fully understood from the description of preferred embodiments of the invention set forth below, together with the accompanying drawings.

DESCRIPTION OF PREFERRED EMBODIMENTS

Figure 1:
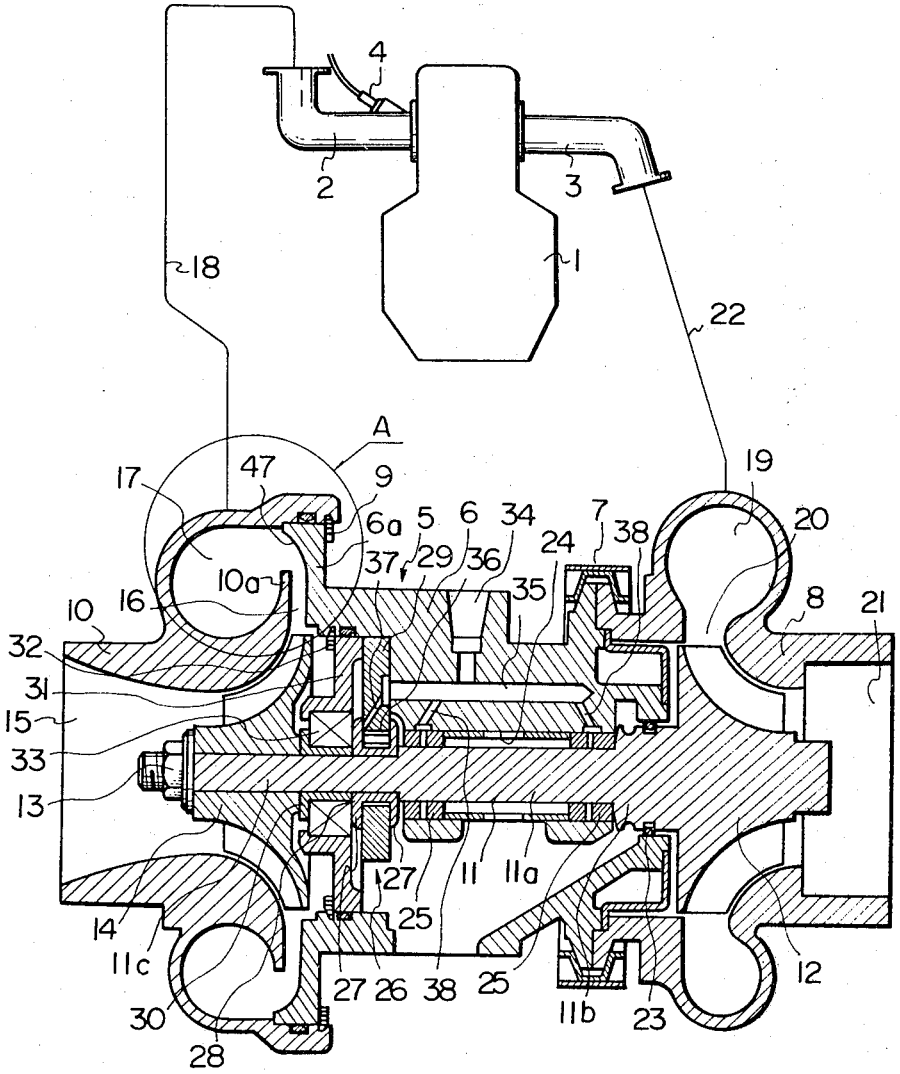
FIG. 1 is a cross-sectional side view of an embodiment of a turbocharger according to the present invention.

Referring to FIG. 1, 1 designates an engine body, 2 an intake manifold, 3 an exhaust manifold, 4 a fuel injector, and 5 a turbocharger. The turbocharger 5 comprises a center housing 6, a turbine housing 8 secured onto one end of the center housing 6 by a band 7, a compressor housing 10 secured onto the other end of the center housing 6 by a snap ring 9, a rotary shaft 11 rotatably inserted into the inside of the center housing 6, a turbine wheel 12 formed in one piece on one end of the rotary shaft 11, and an impeller 14 fixed onto the other end of the rotary shaft 11 by a nut 13. An air inlet 15, a vaneless diffuser 16 and a scroll shaped air discharge chamber 17 are formed in the compressor housing 10, and the air discharge chamber 17 is connected to the intake manifold 2 via an air duct 18. The turbine housing 8 has a scroll shaped exhaust gas inflow chamber 19, a turbine nozzle 20 and an exhaust gas outlet 21 therein, and the exhaust gas inflow chamber 19 is connected to the exhaust manifold 3 via an exhaust duct 22. When the engine is operating, the compressed air within the air discharge chamber 17, which is compressed by the rotating motion of the impeller 14, is fed into the intake manifold 2 via the air duct 18. Then, fuel is injected from the fuel injection 4 into the air which is fed into the intake manifold 2 and, thus, a mixture is formed within the intake manifold 2. After this, the mixture thus formed is fed into the cylinders of the engine body 1. The exhaust gas, discharged from the cylinders of the engine body 1 into the exhaust manifold 3, is fed into the exhaust gas inflow chamber 19 via the exhaust duct 22. The exhaust gas, fed into the exhaust gas inflow chamber 19, is injected from the turbine nozzle 20 to provide the rotating force for the turbine wheel 12 and, then, the exhaust gas is discharged from the exhaust gas outlet 21.

As illustrated in FIG. 1, the rotary shaft 11 comprises a central portion 11*a*, an increased diameter portion 11*b* and a reduced diameter portion 11*c*. A piston ring 23 for sealing is inserted between the center housing 6 and the increased diameter portion 11*b* of the rotary shaft 11. In addition, a pair of spaced floating radial bearings 25 are arranged within a cylindrical bore 24 which is formed within the central housing 6. The rotary shaft 11 is rotatably supported by a pair of the floating radial bearings 25. In order to axially support the rotary shaft 11, a thrust bearing 26 is arranged on the reduced diameter portion 11*c* of the rotary shaft 11. The thrust bearing 26 comprises a runner member 28 having a pair of disc shaped runners 27 thereon, and a stationary bearing plate 29 arranged between the runners 27 and slightly spaced from the runners 27. The runner member 28 is fixed onto the reduced diameter portion 11*c* of the rotary shaft 11 via a spacer 30 and the impeller 14 by the nut 13, and the stationary bearing plate 29 is fixed onto the center housing 6 via a partition member 31 by a snap ring 32. In addition, a seal 33, which is constructed in the form of a mechanical seal, is arranged between the partition member 31 and the spacer 30. A lubricating oil inlet port 34 and a lubricating oil distribution hole 35 are formed in the center housing 6, and the lubricating oil inlet port 34 is connected to the lubricating oil feed pump (not shown). A lubricating oil outflow bore 36, extending in parallel to the axis of the rotary shaft 11, is formed in the stationary bearing plate 29. This lubricating oil outflow bore 36 is connected to the lubricating oil distribution hole 35 via a lubricating oil bore 37. The lubricating oil is fed into the lubricating oil distribution hole 35 from the lubricating oil inlet port 34 and then fed into the lubricating oil outflow bore 36 via the lubricating oil bore 37. After this, the lubricating oil flows into the clearances between the stationary bearing plate 29 and the runners 27 and, thus, the lubricating operation of the thrust bearing 26 is carried out. A pair of lubricating oil feed bores 38, each extending from the lubricating oil distribution hole 35 towards the corresponding floating radial bearings 25, is formed in the center housing 6, and the lubricating operation of the floating radial bearings 25 is carried out by the lubricating oil flowing out from the lubricating oil feed bores 38.

Figure 2:
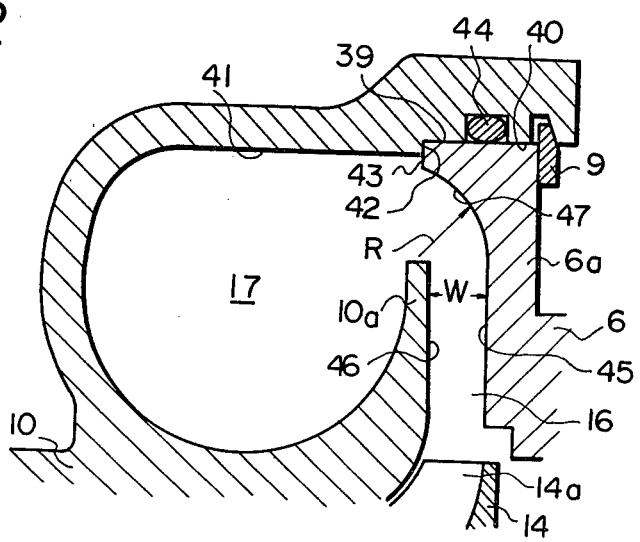
FIG. 2 is an enlarged cross-sectional side view illustrating the portion enclosed by the circle A in FIG. 1.

Referring to FIG. 2, the center housing 6 has a radially extending flange portion 6*a* formed in one piece thereon, and a cylindrically extending inner circumferential wall 40 of the compressor housing 10 is fitted onto a cylindrically extending outer circumferential wall 39 of the flange portion 6*a*. A step portion 42 is formed on the compressor housing 10 at the connecting portion of the inner circumferential wall 40 and a cylindrically extending inner wall portion 41 of the inner wall of the compressor housing 10, which portion 41 is positioned furthest from the impeller 14 (FIG. 1), and an end face 43 of the flange portion 6*a* abuts against the step portion 42. An O ring 44 is inserted between the outer circumferential wall 39 of the flange portion 6*a* and the inner circumferential wall 40 of the compressor housing 10. The compressor housing 10 has an annular separating portion 10*a* radially extending and arranged to face the flange portion 6*a*. The annular separating portion 10*a* extends from an air outlet 14*a* of the impeller 14 to the vicinity of the inner wall portion 41 and separates the vaneless diffuser 16 from the air discharge chamber 17. A first annular surface 45 of the flange portion 6*a*, which faces the vaneless diffuser 16, is arranged in parallel to a second annular surface 46 of the annular separating portion 10*a*, which faces the vaneless diffuser 16 and, therefore, the radially extending annular vaneless diffuser 16 is formed between the first annular surface 45 and the second annular surface 46. The outer end portion of the first annular surface 45 is smoothly connected to a concavely curved surface 47 which gradually curves towards the inner wall portion 41. The cross-section of the concavely curved surface 47 is located on an arc having a radius R the center of which is positioned near the tip of the annular separating portion 10*a*, and it is preferable that the radius R of the arc be within one through three times the width W of the vaneless diffuser 16. In addition, the step portion 42 of the compressor housing 10 has a width which is equal to or smaller than that of the end face 43 of the flange portion 6*a* so that the step portion 42 does not disturb an air stream.

In operation, ambient air, sucked from the air inlet 15 into the impeller 14, is compressed and, at the same time, supplied with velocity energy due to the rotating motion of the impeller 14. Then, the air flows into the vaneless diffuser 16. The flow area of air in the vaneless diffuser 16 is increased as the air moves radially forward and outward. Consequently, as the air moves radially toward and outward in the vaneless diffuser 16, the air is gradually decelerated and, thereby, the velocity energy is gradually converted to an increase in pressure. Then, the air, flowing out from the vaneless diffuser 16 moves forward along the concavely and smoothly curved surface 47 and, thus, the flow direction of the air is gradually deflected towards the air discharge chamber 17. Then, the air is further decelerated in the air discharge chamber 17 and, therefore, the air pressure is further increased in the air discharge chamber 17. The flow velocity of the air, flowing out from the vaneless diffuser 16, is rather high. However, since the flow direction of the air, flowing out from the vaneless diffuser 16, is gradually deflected along the concavely curved surface 47, there is no danger that the energy of the air is ineffectively lost on the concavely curved wall 47. Consequently, the velocity energy of the air is effectively converted to an increase in pressure and, therefore, it is possible to increase efficiency of the compressor.

Figure 3:
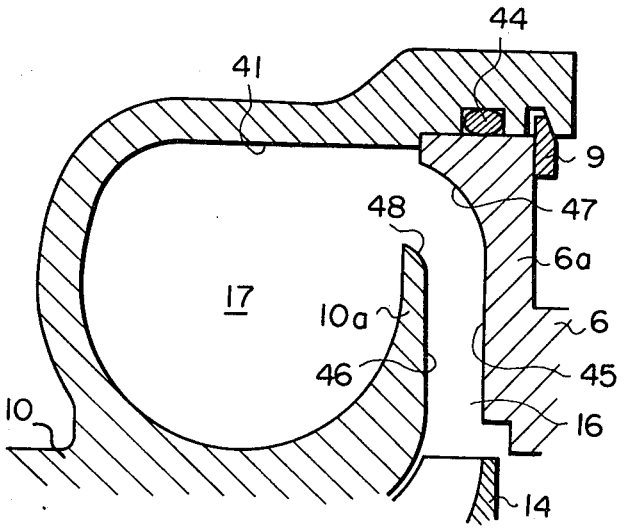
FIG. 3 is an enlarged cross-sectional side view of an alternative embodiment according to the present invention, illustrating the portion which is the same as that illustrated in FIG. 2.

FIG. 3 illustrates an alternative embodiment. In this embodiment, the tip of the annular separating portion 10*a* is shaped in the form of a convexly curved surface 48 which is smoothly connected to the second annular surface 46. Consequently, since the flow direction of the air, flowing out from the vaneless diffuser 16, is gradually deflected along the convexly curved surface 48, there is no possibility that the energy of the air is ineffectively lost on the convexly curved surface 48. Therefore, in this embodiment, it is possible to further increase an efficiency of the compressor.

According to the present invention, since the energy of the air, flowing out from the vaneless diffuser 16, is not ineffectively lost, it is possible to increase efficiency of the compressor. In addition, in the present invention, the compressor housing 10 is fixed onto the center housing 6 in such a way that the inner circumferential wall 40 of the compressor housing 10 is fitted onto the outer circumferential wall 39 of the flange portion 6*a* of the center housing 6. As a result of this, the size of the center housing 6 and the compressor housing 10 can be reduced as compared with that of the prior art. Furthermore, in the present invention, the area of the air inlet opening of the air discharge chamber 17 can be increased as compared with that of the prior art. As a result of this, when the compressor housing 10 is formed by a casting operation, it is possible to easily support a core used for forming the air discharge chamber 17.

While the invention has been described by reference to specific embodiments chosen for purposes of illustration, it should be apparent that numerous modifications could be made thereto by those skilled in the art without departing from the spirit and scope of the invention.

I claim:

1. A turbocharger comprising a center housing, a compressor housing fixed onto the center housing, an impeller arranged in the compressor housing, a scroll shaped air discharge chamber formed in the compressor housing around the impeller and having an inner wall defining the air discharge chamber therein, the inner wall of the air discharge chamber having a cylindrically axially extending inner wall portion which is positioned furthest from the impeller, and a radially extending vaneless diffuser arranged between the impeller and the air discharge chamber, the center housing having a first annular surface which radially extends from the vicinity of the impeller to said inner wall portion of the air discharge chamber, the compressor housing having a radially extending annular separating portion which separates the vaneless diffuser from the air discharge chamber, the annular separating portion having a second annular surface which is arranged parallel to the first annular surface and extends from the vicinity of the impeller to the vicinity of said inner wall portion of the air discharge chamber, the first annular surface and the second annular surface defining the vaneless diffuser therebetween, the first annular surface of the center housing having a concavely curved portion at a position near said inner wall portion of the air discharge chamber, the concavely curved portion gradually curving from the first annular surface towards said inner wall portion of the air discharge chamber, the center housing having a flange portion having the concavely curved portion and a cylindrically extending outer circumferential wall, said inner wall portion of the air discharge chamber having a cylindrically extending inner circumferential wall which is fitted onto the outer circumferential wall of the center housing.

2. A turbocharger as claimed in claim 1, wherein the cylindrically extending inner circumferential wall and the outer circumferential wall are fitted together downstream of the vaneless diffuser.

3. A turbocharger comprising a center housing, a compressor housing fixed onto the center housing, an impeller arranged in the compressor housing, a scroll shaped air discharge chamber formed in the compressor housing around the impeller and having an inner wall defining the air discharge chamber therein, the inner wall of the air discharge chamber having a cylindrically axially extending inner wall portion which is positioned furthest from the impeller, and a radially extending vaneless diffuser arranged between the impeller and the air discharge chamber, the center housing having a first annular surface which radially extends from the vicinity of the impeller to said inner wall portion of the air discharge chamber, the compressor housing having a radially extending annular separating portion which separates the vaneless diffuser from the air discharge chamber, the annular separating portion having a second annular surface which is arranged parallel to the first annular surface and extends from the vicinity of the impeller to the vicinity of said inner wall portion of the air discharge chamber, the first annular surface and the second annular surface defining the vaneless diffuser therebetween, the first annular surface of the center housing having a concavely curved portion at a postion near said inner wall portion of the air discharge chamber, the concavely curved portion gradually curving from the first annular surface towards said inner wall portion of the air discharge chamber, the center housing having a flange portion having the concavely curved portion and a cylindrically extending outer circumferential wall, said inner wall portion of the air discharge chamber having a cylindrically extending inner circumferential wall which is fitted onto the outer circumferential wall of the center housing, the inner circumferential wall of said inner wall portion having a step portion at an inner end thereof, the flange portion having an end face which abuts against the step portion, the end face having a width which is not less than a width of the portion.

4. A turbocharger as claimed in claim 3, wherein the width of the end face is larger than the width of the step portion.

5. A turbocharger as claimed in claim 3, wherein the annular separating portion has a convexly curved tip located nearest the inner wall portion of the air discharge chamber and gradually curving from the second annular surface towards the air discharge chamber.

6. A turbocharger as claimed in claim 3, wherein the concavely curved portion has an arc shaped cross-section.

7. A turbocharger as claimed in claim 6, wherein the arc of the cross-section of the concavely curved portion has a radius which is within one through three times a width of the vaneless diffuser.

8. A turbocharger as claimed in claim 7, wherein the annular separating portion has a tip located nearest the inner wall portion of the air discharge chamber, the center of the radius of the arc being located near the tip of the annular separating portion.

9. A turbocharger as claimed in claim 3, wherein the cylindrically extending inner circumferential wall and the outer circumferential wall are fitted together downstream of the vaneless diffuser.

* * * * *